US005219249A

United States Patent [19]

Junsheng et al.

[11] Patent Number: 5,219,249

[45] Date of Patent: Jun. 15, 1993

[54] REINFORCED CONCRETE LOAD-BEARING PILE FORMING DEVICE

[76] Inventors: Zhang Junsheng; Xu Yangin, both of No. 102, Building 27, Block 8, Hangu District, Tianjin, P.R., China

[21] Appl. No.: 844,734

[22] Filed: Mar. 2, 1992

Related U.S. Application Data

[63] Continuation of Ser. No. 743,831, Aug. 12, 1991, Pat. No. 5,122,013, which is a continuation-in-part of Ser. No. 440,991, Nov. 22, 1989, abandoned.

[30] Foreign Application Priority Data

Nov. 22, 1988 [CN] China ..... 88.2201492

[51] Int. Cl.[5] ..... F02D 5/44

[52] U.S. Cl. ..... 405/303; 405/237; 405/233

[58] Field of Search ..... 405/237, 236, 238, 240, 405/241, 242, 232, 244

[56] References Cited

U.S. PATENT DOCUMENTS

| | | | |
|---|---|---|---|
| 1,181,141 | 5/1916 | Johnson . | |
| 1,279,834 | 9/1918 | Blumenthal | 405/237 |
| 1,404,925 | 1/1922 | Blumenthal . | |
| 1,443,306 | 1/1923 | Blumenthal . | |
| 1,480,878 | 1/1924 | Blumenthal . | |
| 1,501,643 | 7/1924 | Blumenthal et al. . | |
| 1,521,522 | 12/1924 | Fowler . | |
| 1,751,607 | 6/1926 | Smith . | |
| 1,779,643 | 10/1930 | Schwiers | 405/237 X |
| 3,680,274 | 8/1972 | Deike | 405/237 X |
| 3,864,923 | 2/1975 | Turzillo . | |
| 4,396,076 | 8/1983 | Inoue . | |
| 4,411,557 | 10/1983 | Booth . | |
| 4,488,606 | 12/1984 | Inoue . | |
| 4,547,106 | 10/1985 | Lipsker | 405/237 X |

FOREIGN PATENT DOCUMENTS

| | | | |
|---|---|---|---|
| 2436093 | 2/1976 | Fed. Rep. of Germany . | |
| 531827 | of 1921 | France | 405/237 |
| 1010103 | 3/1952 | France . | |
| 1427486 | 12/1965 | France . | |
| 2370130 | 6/1978 | France . | |
| 0670681 | 6/1979 | U.S.S.R. | 405/237 |
| 0827685 | 5/1981 | U.S.S.R. | 405/237 |
| 1016429 | 5/1983 | U.S.S.R. | 405/237 |
| 331945 | 7/1930 | United Kingdom . | |
| 1102682 | 4/1965 | United Kingdom | 405/237 |

*Primary Examiner*—Dennis L. Taylor
*Attorney, Agent, or Firm*—Davis Hoxie Faithfull & Hapgood

[57] ABSTRACT

This invention relates to a reinforced concrete load-bearing pile with multi-branches and enlarged footings for reinforcing foundations, and means and method for forming such a pile. The load-bearing pile of the invention comprises a pile body, and at least one branch and enlarged footing integrated with the pile body. The means for forming the pile comprises a pile cavity drilling/pressing device, a branch cavity pressing device and an enlarged footing cavity pressing device. The method for forming the pile comprises forming a pile cavity, consolidating the base and surroundings of the cavities forming a branch cavity, forming an enlarged footing cavity, and casting the pile.

8 Claims, 4 Drawing Sheets

REINFORCED CONCRETE LOAD-BEARING PILE FORMING DEVICE

This application is a continuation of Ser. No. 07/743,831, filed Aug. 12, 1991, now U.S. Pat. No. 5,122,013 which is a continuation in part of Ser. No. 07/440,991, filed Nov. 22, 1989, now abandoned.

FIELD OF INVENTION

This invention relates to a reinforced concrete load-bearing pile, especially used for consolidating foundations of buildings and bridges or other foundations, and means and method for forming the pile.

BACKGROUND OF THE INVENTION

Present foundations, like driving piles, cast-in-place piles, tree root-like piles, explosion piles and caissons, have disadvantages such as weak load-supporting capability, low stability, waste of material, labor, investment and energy, etc. Especially in the case of complicated soft ground, the foundation tends to settle wholly or unevenly due to the low load capacity of the piles. That brings technical difficulty to both design and construction.

OBJECT OF THE INVENTION

The object of the invention is to provide a reinforced concrete load-bearing pile with multi-branches and enlarged footings for consolidating foundations and means and method for forming such a pile, to overcome the disadvantages in the prevailing technique.

SUMMARY OF THE INVENTION

A reinforced concrete load-bearing pile according to the present invention comprises a pile body, at least one branch and an enlarged footing which are integrated with the pile body.

A means for forming the load-bearing pile comprises a pile cavity drilling/pressing device, a branch cavity pressing device and an enlarged footing cavity pressing device.

In forming a reinforced concrete load-bearing pile according to the present invention, a pile cavity is first formed. Then branch cavities and enlarged footing cavities are formed, and the bases and surroundings of the cavities are consolidated before casting. After consolidating, the supporting power of the bases and surroundings could reach $30T/m^2$. Therefore, when the pile is cast, the formed pile rests on a solid layer. The load bearing capacity of the whole foundation is thus considerably increased.

The load-bearing pile according to the present invention can be wholly or partly cast-in-place after a corresponding cavity is formed.

The present invention will be more fully understood from the following detailed description in connection with the illustrated embodiment in the accompanying drawings.

DETAILED DESCRIPTION OF THE INVENTION

A reinforced concrete load-bearing pile according to the present invention comprises a pile body, at least one branch and enlarged footing which are integrated with the pile body. The branches can be connected to any part of the pile body, preferably arranged in groups along the axis of the pile body. The branches of each group are preferably staggered with those of adjacent groups. The numbers of groups and branches in each group are determined according to the condition of ground, building, etc. The pile body may consist of a concrete pipe with correspondingly arranged openings for forming branches, and a core. The enlarged footings can be connected with the pile body, e.g., at the bottom end of the pile body. The enlarged footing, together with all the branches provides a larger supporting area, thus ensuring higher load-bearing capability of the pile.

Figure 1:
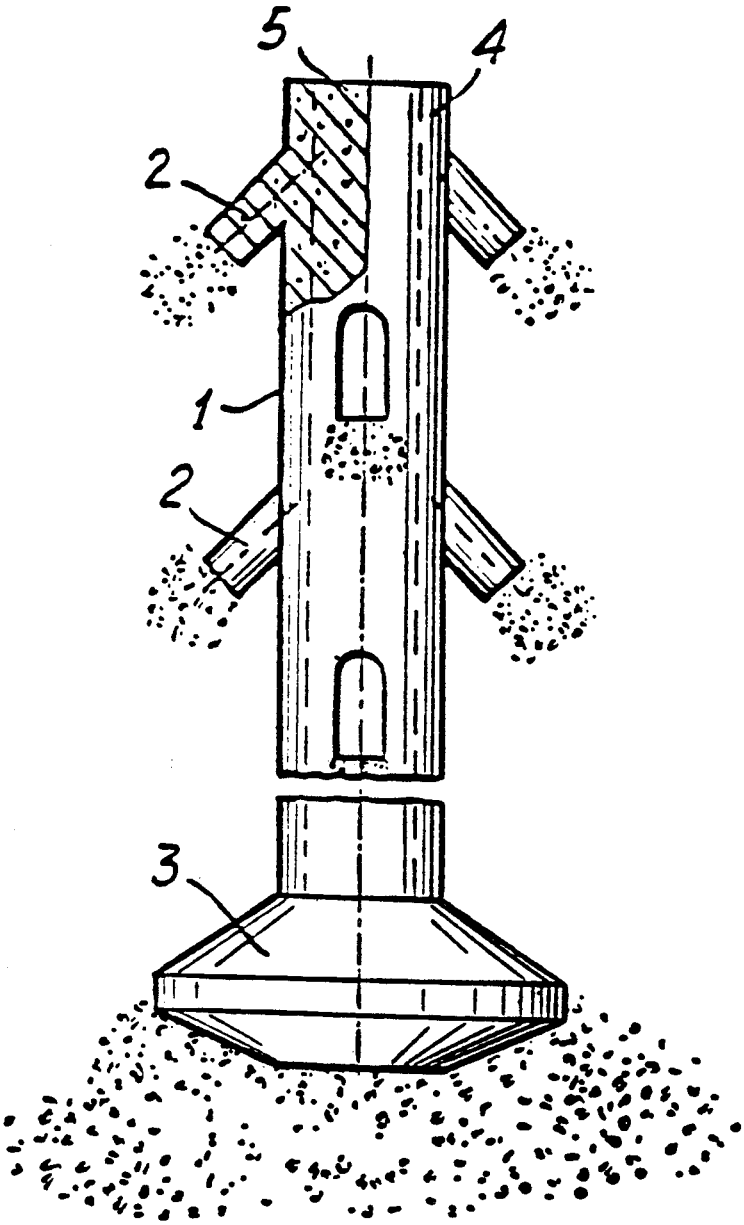
FIG. 1 is a partial cross-sectional view of a load-bearing pile with multi-branches and enlarged footings formed by the method of the present invention.

Referring to FIG. 1, branches 2 are obliquely integrated with a pile body 1, which comprises a concrete pipe 4 and a core 5. The concrete pipe 4 may be embedded with reinforcing steel. The branches 2 are arranged in pairs along the pile body 1. The two branches 2 in each pair are symmetrically arranged and staggered with those in adjacent pairs An enlarged footing 3 connects to the bottom end of the pile body 1.

Figure 2:
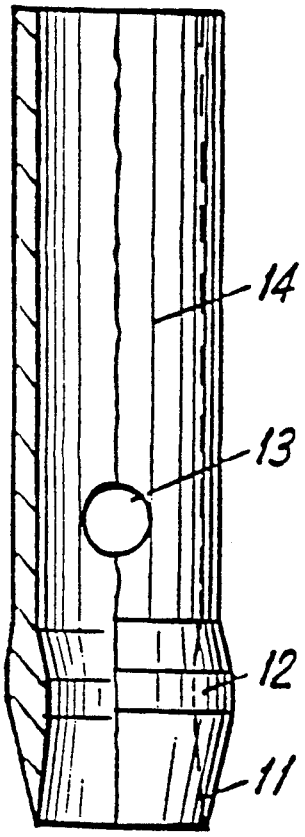
FIG. 2 is a partial cross-sectional view of a pile cavity drilling/pressing device which can be used in the method of the present invention.
Figure 3A:
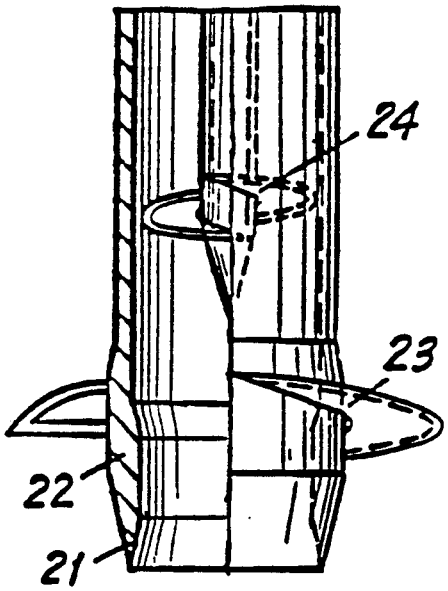
FIG. 3*a* is a partial cross-sectional view of a modified pile cavity drilling/pressing device which can be used in the method of the present invention.
Figure 3B:
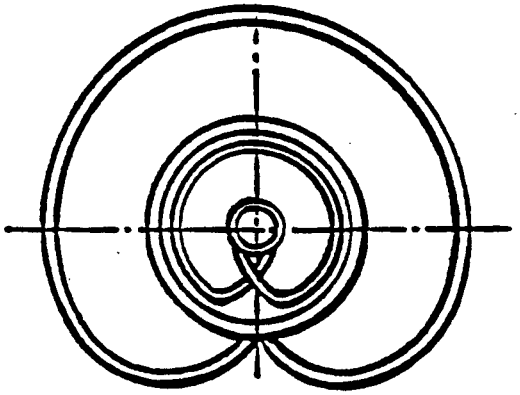
FIG. 3*b* is a top view of the modified pile cavity drilling/pressing device of FIG. 3*a* which can be used in the method of the present invention.
Figure 3C:
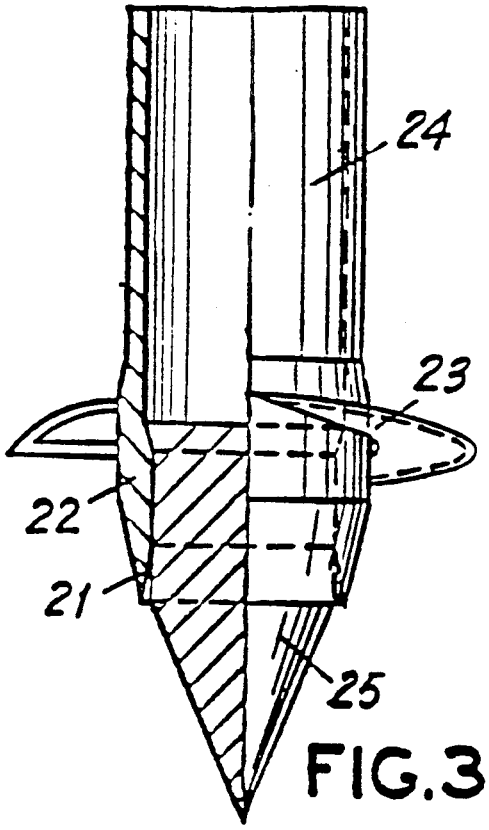
FIG. 3*c* is a partial cross-sectional view of a further modification of the pile cavity drilling/pressing device.
Figure 3D:
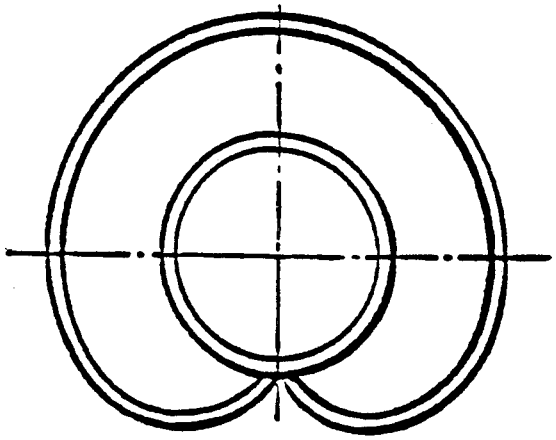
FIG. 3*d* is a top view of the pile cavity drilling/pressing device of FIG. 3*c;*

FIG. 2 shows a pile cavity drilling/pressing device for forming the cavity for the pile body, which is in the form of a pipe. A blade portion 11 is provided at one end of the pipe body 14. The thickness of the pipe wall increases from the blade end. At the end part of the blade portion 11, a strengthening portion is provided in the form of a round collar 12. At least one opening 13 can be provided on the pipe body 14 for forming branch cavities. This device is preferably used on firm ground, but may be used with soft ground as well. It can be driven into the earth by pressing. To remove soil inside the pipe body to form the pile cavity, means such as an earth auger with screw blades can be provided, also as shown in FIG. 3.

FIG. 3 shows a modified pile cavity drilling/pressing device, which is preferred for soft ground. This device is further provided with a spiral cutting blade 23 connected to the outside of the pipe body. Means for removing soil, such as an earth auger 24 or a pump (not shown) is provided. A movable conical head 25 may alternatively be provided at the blade end of the pipe body to form a pile cavity without removal of any soil. See FIGS. 3*c* and 3*d*. This device can be driven into the ground by rotation by a drill.

Figure 4:
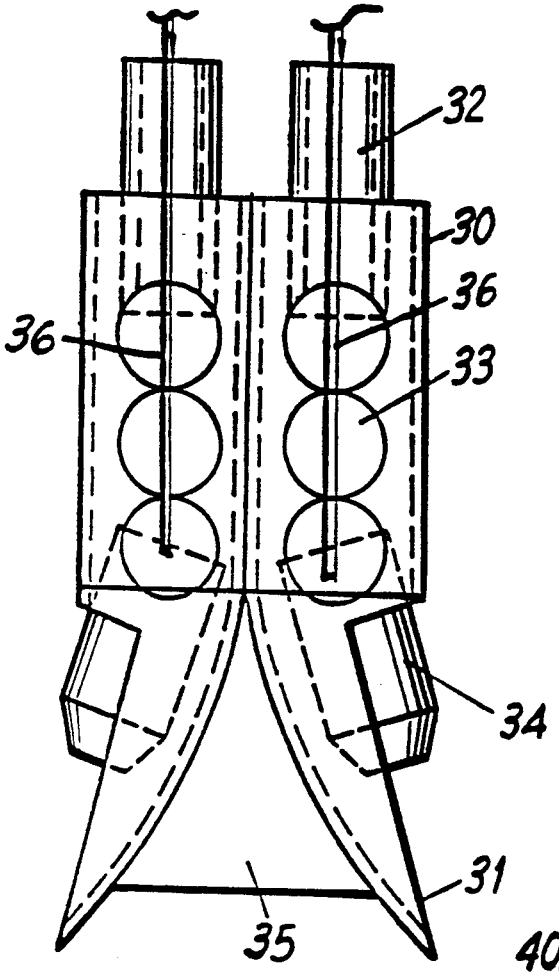
FIG. 4 is a partial cross-sectional view of a branch cavity pressing device which can be used on the method of the present invention.

FIG. 4 shows a preferred embodiment of a branch cavity pressing device which is symmetrically twin-armed. Each of the arms has a chisel holder 30, a support 31 connected to the chisel holder's bottom, and a chisel arranged in the cavity of the chisel holder 30. The chisel is composed of a chisel end 32, power transmitting parts, which are preferably balls 33, and a chisel head 34, which are flexibly connected by conventional means, such as cables 36. The chisel end 32, power transmitting balls 33 and chisel head 34 can each have holes along their center lines for receiving the steel cable 36. The chisel bearings 30 can be connected or integrated. A movable support 35 is preferably provided at the bottoms of the supports 31, which can be used for positioning and support. The supports 31 are obliquely arranged and can be used as guides for the chisel head 34. A single armed device may be used as well.

Figure 5:
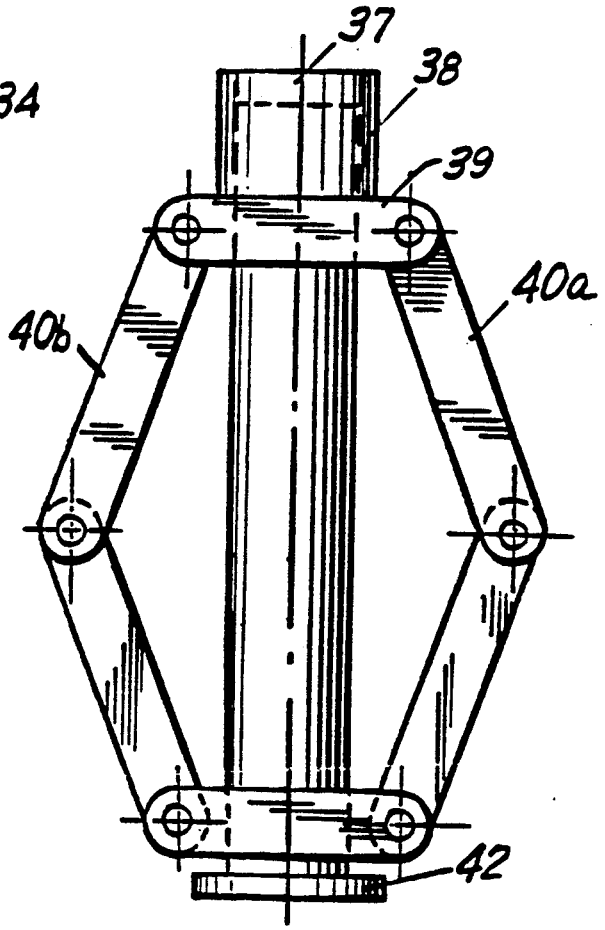
FIG. 5 is a side view of an enlarged footing cavity pressing device which can be used in the method of the present invention.

FIG. 5 shows a preferred enlarged footing cavity pressing device. A fixed collar 42 is provided at one end of a column 37. Two collars 39 are slidably mounted on the column 37. A pair of pivoted arms 40*a* pivot with the movable collars 39 at the same side of the column 37, and another pair of arms 40*b* at the other side. These two pairs of arms are symmetrically arranged. A sleeve 38 is slidably mounted at the other end of the column 37. As the sleeve 38 moves downward, the pivoted arms 40 are folded. This increases the radial dimension of the device. Additional pairs of pivot arms may be added and symetrically arranged about the column 37. The side surfaces of the arms 40*a*, 40*b*, which engage and consolidate the soil may be of circular, rectangular or other shapes. The width of the arms may vary in accordance with construction conditions such as the soil. A wide arm is preferably used for a soft layer to increase working efficiency while a narrow arm is preferred in a firm soil condition. A single pair of arms 40 may be used, as well.

In forming a reinforced concrete load-bearing pile according to the present invention, the pile cavity is first formed with either the pipe type or screw type pile cavity drilling/pressing device described above and shown in FIGS. 2 or 3, depending on the condition of soil layer. The pipe type pile cavity drilling/pressing device shown in FIG. 2 is driven into the earth by any conventional means, such as a pile driver or hydraulic press. The screw type pile cavity drilling/pressing device shown in FIG. 2 is driven by a drill or other conventional means, as is known in the art. The pile cavity drilling/pressing device can be driven into the ground either vertically or at an angle of inclination. The earth within the pipe body can either be removed by an earth auger as described, or by other conventional means, such as a mud pump. If the movable conical head 25 is used, the soil is compressed and pushed out of the way. The pile cavity drilling/pressing device is then withdrawn and the pile cavity is thus formed.

In the case of a soft soil layer, the pile cavity drilling/pressing device, which has at least one opening on the pipe body, may be left in the formed pile cavity to support the surrounding earth of the pile cavity to prevent it from collapsing when the branch cavities and enlarged footing cavities are being formed. If the ground is stiff, the pile drilling/pressing device can be taken out when the cavity is made. If the soil layer is prone to collapse, the pile drilling/pressing device may be withdrawn first, and a precast concrete tube 4 is put in instead. Then the branch cavities and the enlarged footing cavities are made.

The branch cavities are formed with the branch cavity pressing device shown in FIG. 4. The device is introduced along and into the pile cavity with the lower end of the support pointing to a place where the branch cavity is to be made. The branch cavity pressing device can be held in place through conventional means. Pressure can be exerted on the chisel end 32 by a pile driver or other conventional pressing means. Pressure exerted on the chisel end is transferred to the chisel head 34 by means of the power transmitting balls 33. The pressure forces the connected chisel end, transmitting balls and chisel head to move within the chisel bearing cavity of the arm. The chisel head 34 pushes the surrounding soil out of the way and compresses the soil under the guidance of the support to form the branch cavity and consolidate the surroundings and the base of the branch cavity, which become the supporting surfaces of the pile. The flexible connection of the chisel end, transmitting balls and the chisel head together with the obliquely arranged guiding support enable the downward pressure exerted on the chisel end to be converted into an oblique pressure to form the branch cavity.

If the pipe body of the pile cavity drilling/pressing device being used in the process of forming the branch cavity as a supporting means in soft soil, the lower end of the support of the branch cavity pressing device is led to point to the opening 13 on the pipe of the pile cavity forming device. The branch cavity is then formed as described, above. The lower end of the support of the branch cavity pressing device can be directed to different openings on the pipe of the pile cavity forming device to form all the branch cavities when the openings provided on the pipe correspond to the branch cavities required. When only one or a group of openings ar provided at the lower portion of the pipe, the pipe can be raised a distance and additional branch cavities can be formed through the opening or openings at the higher level in the pile cavity. If a precast concrete pipe 4 is used, the branch cavity drilling/pressing device can be inserted through openings in the pipe.

The branches of the pile are formed in groups. Each group contains one or several branches which are arranged on the same level. The branches in each group can be equally distributed around the pile body and staggered with those in the adjacent groups (FIG. 1). The staggered branch cavities can be formed by turning the branch cavity forming device through an angle after the device is raised a sufficient level to form the second group of branch cavities.

If additional consolidation is required, filling materials can be added to the branch cavities. The flexibly connected chisel end, transmitting balls and chisel head can be further connected to the same pile driver or other conventional pressing means used to exert pressure on the chisel end in forming the branch cavity, and therefore can be withdrawn from the cavity of the chisel bearing of the branch cavity forming device when the driving head or the pile crown of the pile driver is raised. Thus, the cavity of the chisel bearing of the branch cavity forming device is empty and ready for adding filling materials into the branch cavity. When the driving head on the pile crown of the pile driver falls again, the flexibly connected parts can be introduced back in the cavity of the chisel bearing. The pressure exerted by the pile driver through the driving head will compact the added filling materials to make them combine with the surrounding soil and therefore, further consolidate the surroundings and the base of the branch cavity. The supporting power of the surroundings and the bases could reach $50T/m^2$ after the additional consolidation.

The enlarged footing cavity could be formed with the enlarged footing cavity pressing device of FIG. 5. The device is introduced into the pile cavity to a predetermined depth wherein an enlarged footing cavity is to be made. When an enlarged footing cavity is required at the bottom position of the pile cavity, the device is inserted into the pile cavity until it reaches the bottom of the pile cavity. The sleeve 38 of the enlarged footing cavity pressing device is pressed downward by a conventional pressing means, such as a pile driver. The pressing action of the sleeve causes the pivoted arms to protrude outwardly and exert pressure on the soil in the surrounding layer. The pressure exerted on the sleeve can also be transmitted through the pivoted arms to the bottom of the device to press and consolidate the soil on the base of the cavity. Then the sleeve is raised to draw the protruded arms back to a position where these arms are substantially parallel to the column. The device can then be easily turned by any conventional means through an angle to continue pressing the surrounding soil when the sleeve is pressed again. This process continues until the whole base and surrounding soil of the cavity is pressed and consolidated. The load bearing capacity of the consolidated layer may reach $30T/m^2$.

The enlarged footing cavity can also be formed with the branch cavity pressing device of FIG. 4. The device is introduced into the pile cavity to the required position and held in place by conventional means. When an enlarged footing cavity is required at the bottom of the pile cavity, the device may be led into the pile cavity until it reaches the bottom thereof. The operation of the device in forming the enlarged footing is similar to its operation in forming branch cavities, except that the device is rotated during use. The chisel is retracted into the chisel cavity and the device is turned through an appropriate angle. Then the chisel can be pressed again. Moreover, the pressure exerted on the chisel end may also be transmitted to the movable support through the support and other parts to press the soil on the bottom to help form the enlarged footing cavity and consolidate the base thereof. Alternatively, the base of the enlarged footing cavity can also be formed and consolidated by rammers or other pressing means.

When a better consolidation effect is required, filling materials can be added into the cavity and the consolidating process continued to combine the added filling materials with surrounding earth and compact them. Such additional consolidation may considerably increase the load-bearing capacity of the supporting surface of the enlarged footing cavity.

The pile can be casted after the whole cavity is formed. The branches can be precasted and put into the branch cavity through the branch cavity pressing device when the branch cavities are formed. This can be done by inserting the precasted branches into the empty cavity of the chisel bearing of the branch cavity pressing device when the chisel is taken out. Reinforcing steel bars can be put into the pile cavity when the pile is being casted.

This invention has the following advantages:

1. A load-bearing pile according to the present invention has substantially higher load-carrying capability and foundation stability than those of ordinary load-bearing piles, overcoming at the same time residual settlement problems of foundations and rendering possible realization of a more solid and stable foundation;

2. With this kind of pile, more than 50% of the construction material may be saved compared with other types of foundations. Also, there may be economy in manpower, energy and investment, shortening the construction period and lowering cost; and 3. The formation means of the pile of the present invention has the advantages of simple construction and easy maintenance, overcoming the difficulty of making branch cavities, rendering possible the embodiment and application of the techniques of the load-bearing pile according to the present invention.

Thus, while the invention has been described in relation to a particular embodiment, those having skill in the art will recognize modifications of materials, structure and the like which will still fall within the scope of the present invention.

We claim:

1. A branch cavity pressing device for use in forming cavities in a reinforced concrete load bearing pile, the device comprising a base portion, a support means connected to the base portion, and a means for consolidating earth capable of being moved with respect to the support means, the support having a guiding surface along which the means for consolidating earth can move, for guiding the means for consolidating earth into surrounding earth to carry out consolidation.

2. The branch cavity pressing device of claim 1 wherein the support means comprises at least one chisel holder having a bottom and a chisel cavity, the guiding surface being connected to the bottom of the chisel holder.

3. The branch cavity pressing device of claims 1 or 2 wherein the means for consolidating comprises at least one movable chisel arranged within the chisel cavity, the chisel capable of being directed by the guiding surface outward, away from the chisel holder, to carry out consolidation.

4. The branch cavity pressing device of claim 3 wherein the chisel comprises a chisel end, power transmitting means and a chisel head which are flexibly connected such that movement of the chisel end causes movement of the chisel head.

5. A branch cavity pressing device for use in forming branch cavities in a reinforced concrete load bearing pile, the device comprising a first and second arm, each arm comprising a chisel holder having a bottom portion and a cavity; a guide connected to the bottom portion, the guide having a surface directed outward and away from the chisel holder; a chisel end, power transmitting means and a chisel head flexibility connected to and against one another and being capable of being moved through the cavity of the chisel holder such that movement of the chisel end causes movement of the chisel head along the surface of the guide.

6. The branch cavity pressing device of claim 3 wherein said support extends outwardly and away from the chisel holder.

7. The branch cavity pressing device of claim 5 wherein the power transmitting means are ball shaped.

8. The branch cavity pressing device of claim 5 wherein said arms are symmetrically arranged and the chisel holder of said arms are integrated.

* * * * *